US008814508B2

(12) United States Patent
Puggioni et al.

(10) Patent No.: US 8,814,508 B2
(45) Date of Patent: Aug. 26, 2014

(54) HEAT EXCHANGER FOR CENTRIFUGAL COMPRESSOR GAS SEALING

(75) Inventors: Marcello Puggioni, Sesto Fiorentino (IT); Marco Pelella, Prato (IT); Nicola Banchi, Florence (IT); Alessio Milani, Florence (IT); Marco Boncinelli, Florence (IT)

(73) Assignee: General Electric Company, Schenectady, NY (US)

( * ) Notice: Subject to any disclaimer, the term of this patent is extended or adjusted under 35 U.S.C. 154(b) by 2660 days.

(21) Appl. No.: 10/572,170

(22) PCT Filed: Sep. 15, 2004

(86) PCT No.: PCT/EP2004/010459

§ 371 (c)(1),
(2), (4) Date: Jan. 2, 2007

(87) PCT Pub. No.: WO2005/026589

PCT Pub. Date: Mar. 24, 2005

(65) Prior Publication Data

US 2007/0102139 A1 May 10, 2007

(30) Foreign Application Priority Data

Sep. 18, 2003 (IT) ..... MI2003A001780

(51) Int. Cl.
*F01D 25/08* (2006.01)

(52) U.S. Cl.
USPC ..... 415/177; 277/430

(58) Field of Classification Search
USPC ..... 415/177, 178, 180; 277/430, 930
See application file for complete search history.

(56) References Cited

U.S. PATENT DOCUMENTS

| | | | | |
|---|---|---|---|---|
| 2,223,519 | A | 12/1940 | Hornschuch | |
| 3,581,583 | A | 6/1971 | Vinciguerra | |
| 3,746,350 | A | 7/1973 | Mayer et al. | |
| 4,872,689 | A * | 10/1989 | Drumm | 277/408 |
| 5,125,792 | A | 6/1992 | Korenblit | |
| 5,718,560 | A * | 2/1998 | Lorenzen | 415/47 |
| 6,202,537 | B1 | 3/2001 | Havran | |

FOREIGN PATENT DOCUMENTS

| | | | |
|---|---|---|---|
| DE | 641288 | C | 1/1937 |
| DE | 2034586 | A1 | 1/1972 |
| DE | 3132144 | A1 | 3/1983 |
| EP | 0280778 | A2 | 9/1988 |
| EP | 0506239 | A | 9/1992 |
| FR | 1023818 | A | 3/1953 |
| GB | 1162103 | A | 8/1969 |
| GB | 1301309 | A | 12/1972 |
| JP | 2002155892 | A | 5/2002 |
| WO | 97/01053 | A1 | 1/1997 |

OTHER PUBLICATIONS

International Search Report and Written Opinion dated Dec. 12, 2004 from corresponding Application No. PCT/EP2004/010459.
Notice of Opposition dated Mar. 26, 2009 from corresponding EP Application No. 04765352.2.
Summons to Attend Oral Proceeding dated Nov. 4, 2011 from corresponding EP Application No. 04765352.2.

* cited by examiner

*Primary Examiner* — Dwayne J White
(74) *Attorney, Agent, or Firm* — Global Patent Operation

(57) ABSTRACT

Heat exchanger device for a gas seal (1) for centrifugal compressors equipped with a fluid heat exchanger (3) positioned between the gas seal (1) and the housing wall of the seal to keep the temperature of the seal (1) low in the case of high temperatures of the wall and/or compressed gas.

13 Claims, 3 Drawing Sheets

2
3
6
8
7
4
1
10

HEAT EXCHANGER FOR CENTRIFUGAL COMPRESSOR GAS SEALING

FIELD OF THE INVENTION

The present invention relates to a heat exchanger device for a gas seal for centrifugal compressors.

DESCRIPTION OF BACKGROUND

As is known, a centrifugal compressor is a machine which returns a compressible fluid at a higher pressure than that at which it received it, giving it the necessary energy for the pressure change, by the use of a rotor with one or more impellers.

Each impeller, which is connected to the rotor, comprises a certain number of blades, radially arranged, which transfer energy to the gas. The centrifugal step also comprises stator parts which contribute to converting the kinetic energy of the impeller into gas pressure energy and cause the gas flow in the compressor.

The gas compression area is delimited by walls, generally flanges, which support gas seals suitable for preventing the pressurized gas from leaving the compressor.

After compression, the temperature of the gas at the compressor delivery can reach a high value; this envisages an extremely accurate selection of the materials and particularly of the gas seal materials.

When the temperatures at the compressor delivery are higher than 200° C., there is a sudden perishing of the washers, O-rings and vital parts of the gas seal.

Furthermore, in some chemical and petrochemical processes, in addition to reaching an extremely high temperature at the delivery, about 275° C., the gas treated is also harmful and for this reason must absolutely remain inside the pressurized parts.

It has so far appeared to be impossible to block this harmful gas due to this perishability, as a result of the high temperature, of the vital parts of the gas seal.

It is therefore necessary to find a device which creates an acceptable environment for the gas seal in the case of high temperatures.

SUMMARY

An objective of the present invention is therefore to solve the problems of the known art by providing a heat exchanging device which does not allow the gas seal to reach the temperature of the process gas.

A further objective of the present invention is to provide a device which allows the cooling of the gas seal, which is simple and economical to produce.

These and other objectives are achieved by the present invention which has all the characteristics illustrated in the enclosed claim 1.

Further characteristics of the invention are evident from the subsequent claims.

Substantially, the heat exchanger device for a gas seal for centrifugal compressors comprises a fluid heat exchanger situated downstream of the impeller(s) of the compressor to prevent the discharge of gas into the atmosphere and lower the temperature of the seal itself.

According to an advantageous aspect of the present invention, the heat exchanger is cylindrical and envelopes the seal, substantially arranged in the direction of the rotor axis.

According to another aspect of the present invention, the heat exchanger is positioned between the seal and supporting flange of the seal.

According to the present invention, the exchanger advantageously comprises an inlet opening and an outlet opening of the cooling liquid connected to each other by a coiled path.

According to a further preferential aspect of the present invention, the inlet duct of the seal gas passes through the exchanger.

DESCRIPTION OF DRAWINGS

The characteristics and advantages of the gas seal exchanger according to the present invention will appear more evident from the following illustrative and non-limiting description, referring to the enclosed schematic drawings, wherein.

DETAILED DESCRIPTION

Figure 1:
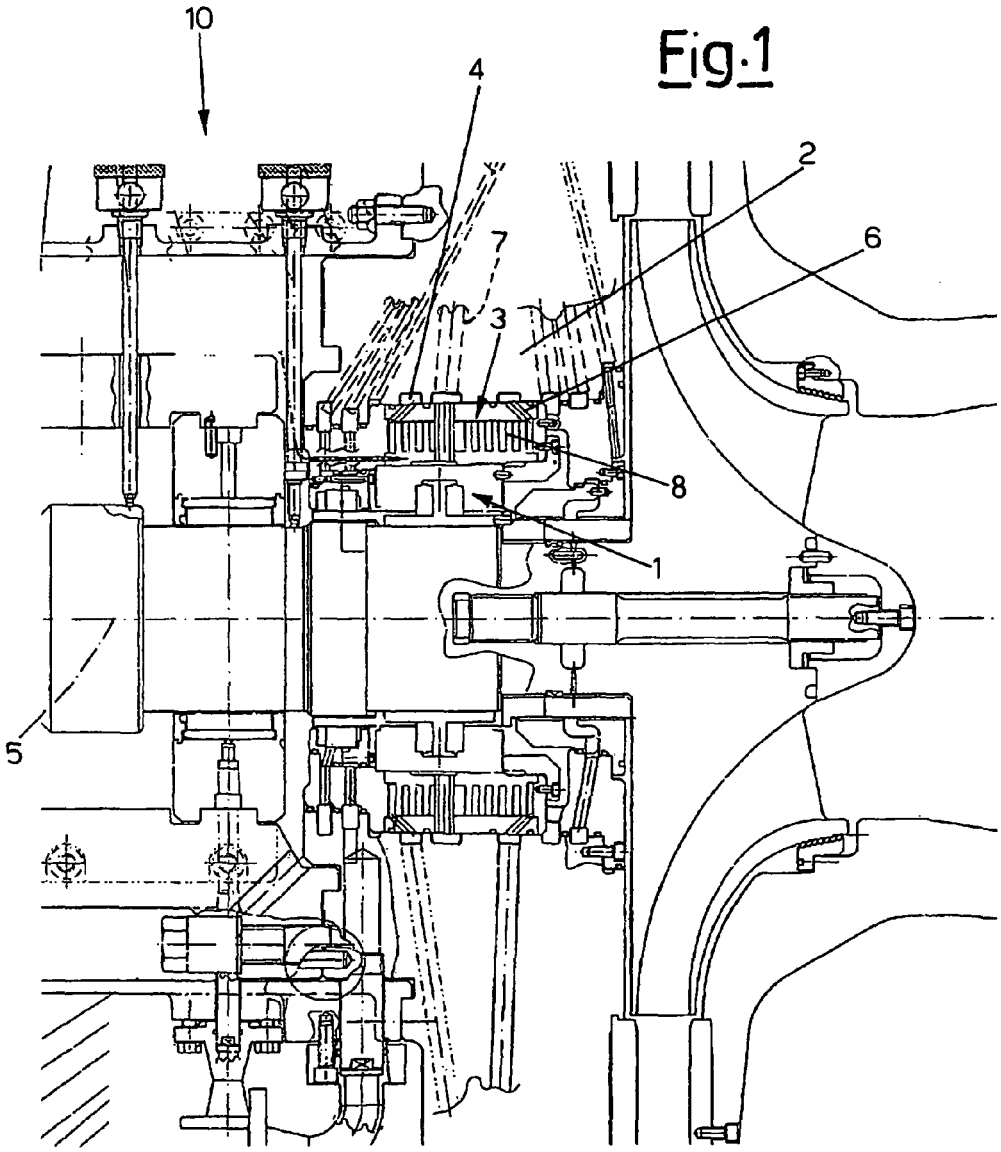
FIG. 1 is a partial longitudinal schematic view of a centrifugal compressor equipped with the gas seal exchanger according to the present invention.
Figure 2:
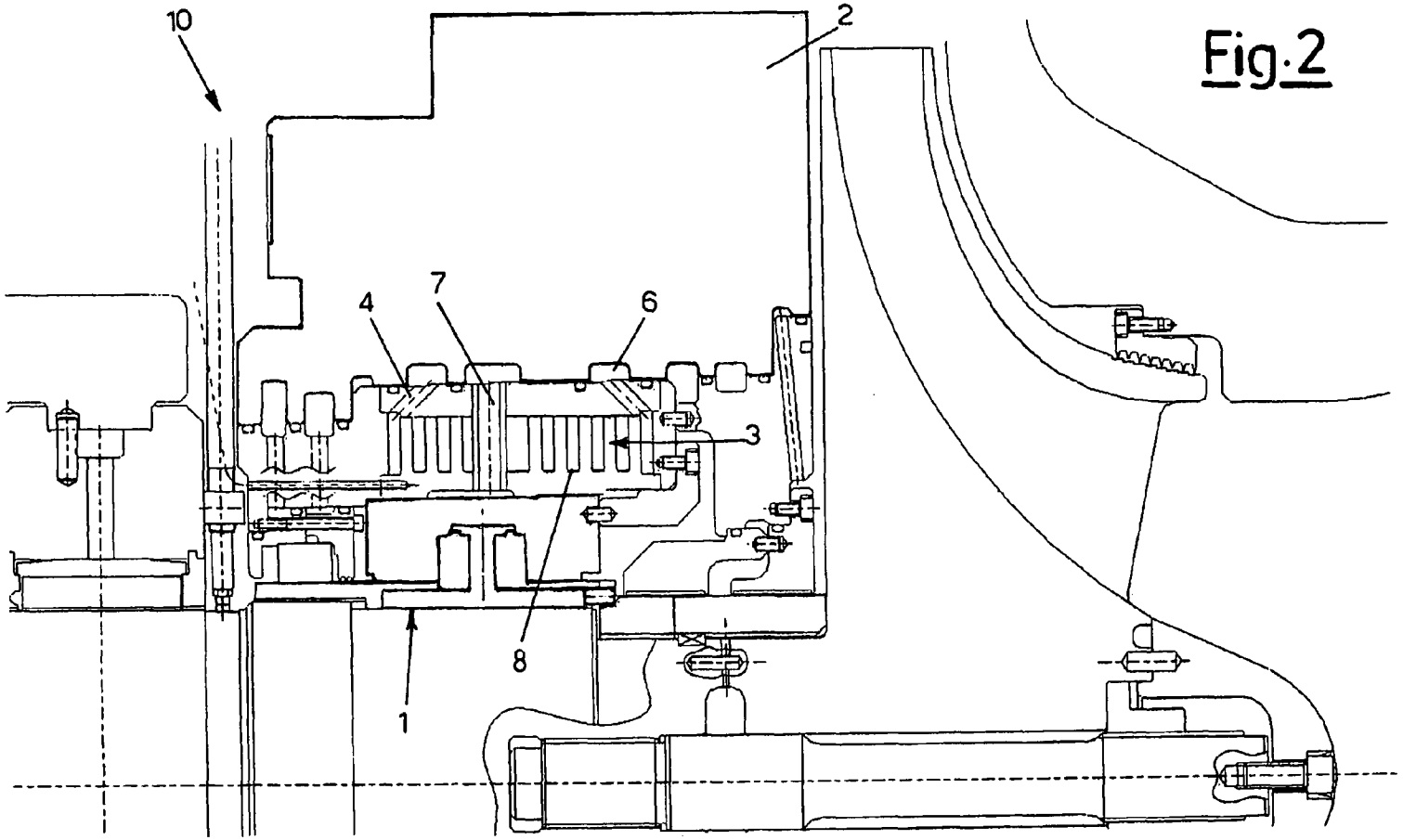
FIG. 2 is an enlarged schematic view of a detail of the gas seal exchanger of FIG. 1.

With reference to the figures, these show a gas seal 1 according to the present invention situated directly downstream of the impellers and supported by a flange 2 to prevent the process gas, i.e. the gas compressed by the compressor 10, being discharged into the environment. The seal 1 is equipped with a fluid heat exchanger 3, situated between the seal 1 and the housing wall of the seal 1. The exchanger 3 is a cylindrical circular exchanger, arranged in an axial direction with respect to the shaft 5 of the impeller(s) so as to enfold the seal 1, as shown in FIG. 1.

The exchanger 3 also extends between the seal 1 and the supporting flange 2 of the seal itself and is fixed to this with the known means.

Figure 3:
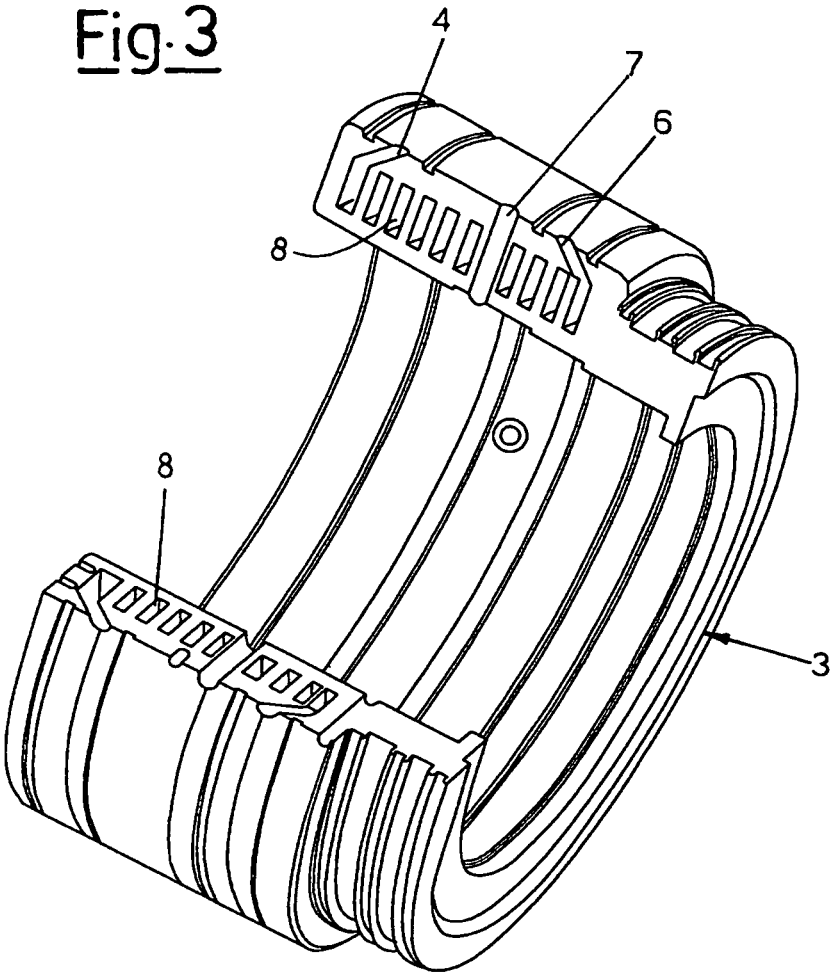
FIG. 3 is a perspective schematic view of the heat exchanger according to the present invention.

Again with reference to FIGS. 1 and 3, the exchanger 3 comprises at least one inlet opening 4 and at least one outlet opening 6 of the cooling liquid, which are situated above.

The openings 4 and 6 are connected to each other by means of a coiled path 8 for the cooling liquid arranged so as to completely envelope the seal 1, as mentioned above.

Between the seal 1 and flange 2 between the inlet opening 4 and outlet opening 6 of the cooling liquid, at least one inlet duct 7 of the seal gas is positioned so as to be surrounded by the exchanger 3.

The seal blockage gas is supplied, in the known way, through the supply duct 7.

The cooling liquid used in the exchanger 3, according to the present invention, is water which, by circulating through the coiled path 8, cools the internal surface of the exchanger 3 creating an acceptable temperature (100° C.) for the gas seal.

It can thus be seen that the seal 1 according to the present invention achieves the objectives listed above.

In particular, it allows the temperature of the environment in which the seal is housed, to be lowered, enabling its correct functioning in terms of performance and duration.

Numerous modifications and variations can be applied to the gas seal exchanger of the present invention, thus conceived, all included within the scope of the inventive concept.

Furthermore, in practice, the materials used, as also their dimensions and components can vary according to technical demands.

The invention claimed is:

1. A heat exchanger device for a gas seal for a centrifugal compressor, the device comprising:

a fluid heat exchanger positioned between the gas seal of the compressor and a housing wall of said seal; and at least one inlet duct entering through the fluid heat exchanger and configured to supply a blockage gas to the gas seal, wherein the fluid heat exchanger is configured to keep the temperature of said seal low in the case of high temperatures of the wall and/or compressed gas.

2. The exchanger device according to claim 1, wherein said exchanger is a circular exchanger suitable for enveloping said seal.

3. The exchanger device according to claim 1, wherein said exchanger extends between said seal and a supporting flange of said seal.

4. The exchanger device according to claim 1, wherein said exchanger further comprises:

at least one inlet opening; and at least one outlet opening connected to each other by a coiled path, said path for flowing a cooling liquid through said exchanger device.

5. The exchanger device according to claim 1, wherein said at least one inlet duct passes through the centre of the exchanger.

6. The exchanger device according to claim 1, wherein the exchanger is configured to receive a cooling liquid.

7. The exchanger device according to claim 4, wherein the coiled path completely encloses the gas seal.

8. The exchanger device according to claim 1, wherein the fluid heat exchanger is configured to reduce a temperature of the gas seal.

9. The exchanger device according to claim 1, further comprising:

a shaft configured to rotate inside the fluid heat exchanger.

10. The exchanger device according to claim 9, further comprising:

an impeller attached to the shaft.

11. The exchanger device according to claim 10, further comprising:

a centrifugal compressor including the impeller.

12. The exchanger device according to claim 1, wherein the fluid heat exchanger is configured to reduce a temperature of the gas seal from more than 200° C. to around 100° C.

13. The exchanger device according to claim 6, wherein the cooling liquid is water.

* * * * *